US005789724A

United States Patent [19]

Lerssen et al.

[11] Patent Number: 5,789,724

[45] Date of Patent: Aug. 4, 1998

[54] OVEN DOOR CHOKE WITH CONTAMINATION BARRIER

[75] Inventors: Ben D. Lerssen, Sioux Falls, S. Dak.; Dan L. Johnson, Cedar Rapids, Iowa; John D. Robeson, Cedar Rapids, Iowa; Larry M. Engebritson, Cedar Rapids, Iowa; Will D. Taber, Kansas City, Mo.

[73] Assignee: Amana Company L.P., Amana, Iowa

[21] Appl. No.: 688,485

[22] Filed: Jul. 30, 1996

[51] Int. Cl.[6] ..... H05B 6/76

[52] U.S. Cl. ..... 219/741; 219/740; 126/200; 174/35 R

[58] Field of Search ..... 219/738, 739, 219/740, 741, 742, 743, 744, 756; 126/190, 198, 200; 174/35 R, 35 GC

[56] References Cited

U.S. PATENT DOCUMENTS

| | | | |
|---|---|---|---|
| 3,731,035 | 5/1973 | Jarvis et al. | 219/739 |
| 4,206,338 | 6/1980 | Katona | 219/739 |
| 4,211,910 | 7/1980 | Kusunoki et al. | 219/740 |
| 4,390,767 | 6/1983 | Bucksbaum et al. | 219/739 |

FOREIGN PATENT DOCUMENTS

| | | | |
|---|---|---|---|
| 57-23727 | 2/1982 | Japan | 219/740 |
| 58-85020 | 5/1983 | Japan | 219/742 |

*Primary Examiner*—Philip H. Leung
*Attorney, Agent, or Firm*—Marshall, O'Toole, Gerstein, Murray & Borun

[57] ABSTRACT

An oven door has an RF choke, an outer choke cover, first and second inner choke cover members, and a contaminant barrier The RF choke has a first side which is oriented away from a cooking chamber of an oven, and the RF choke has a second side which is oriented toward a cooking chamber of an oven. The outer choke cover abuts the first side of the RF choke. The first inner choke cover member has a gasket, and the first inner choke cover member is microwave safe. The contaminant barrier abuts the gasket of the first inner choke cover member. The second inner choke cover member abuts the contaminant barrier so that the contaminant barrier is sandwiched between the first and second inner choke cover members. The second inner choke cover member is microwave safe.

31 Claims, 7 Drawing Sheets

OVEN DOOR CHOKE WITH CONTAMINATION BARRIER

TECHNICAL FIELD OF THE INVENTION

The present invention is directed to an oven door having a choke and, more particularly, to an oven door which protects the choke against contaminants such as those originating within a cooking chamber of the oven.

BACKGROUND OF THE INVENTION

Ovens, such as microwave ovens and combination ovens which, for example, combine microwave cooking with other forms of cooking (e.g., convection cooking), typically include an oven body and an oven door. The oven body defines an oven chamber within which food may be processed, and the oven door interacts with the oven body to permit access to the oven chamber.

A typical oven door, which is used on a microwave oven, has a choke for preventing leakage of the RF energy that is generated by the oven to process the food in the oven chamber. If the choke is exposed to the oven chamber of the oven, vapor and other products of food processing (such as spatters) produced during processing of food within the oven may soil the choke. Therefore, the choke must be easily accessible so that the choke may be periodically cleansed. However, the choke, which typically includes a plurality of choke fingers, has a geography which makes it difficult to clean.

Alternatively, a contaminant barrier (which may be referred to a choke cover) may be provided to prevent the vapor and other products of food processing produced during processing of food within the oven from reaching the choke. However, contaminant barriers in the past have not been satisfactory because of warpage, cracking, blistering, melting, arcing, absorption of microwave energy at high temperature, and the like. Many of these problems result because of the thermal stresses exerted on the contaminant barrier as the door and contaminant barrier cool, because the inner perimeter of an oven door is typically anchored while its outer perimeter is free to float, because of high thermal expansion and contraction of the contaminant barrier itself, because of a lack of mechanical structure in the contaminant barrier, because the heat limit of the choke cover materials has been exceeded, and because of other material characteristics.

The present invention is directed to a contaminant barrier which solves one or more of the above noted problems.

SUMMARY OF THE INVENTION

According to a first aspect of the present invention, an oven door comprises an RF choke, an outer choke cover for the RF choke, and an inner choke cover for the RF choke. The RF choke is retained between the outer and inner door covers. The inner choke cover includes first and second members and a contaminant barrier. The first member is between the RF choke and the contaminant barrier, and the second member is between the contaminant barrier and an oven compartment of an oven. The first member is RF transparent and withstands temperatures in excess of 350° F., and the second member is RF transparent and withstands temperatures in excess of 500° F.

According to another aspect of the present invention, an oven door comprises an RF choke, an outer choke cover, a first inner choke cover member, a contaminent barrier, and a second inner choke cover member. The RF choke has a first side which may be oriented away from a processing chamber of an oven, and the RF choke has a second side which may be oriented toward a processing chamber of an oven. The outer choke cover abuts the first side of the RF choke. The first inner choke cover member has a gasket, and the first inner choke cover member is RF transparent and withstands temperatures in excess of 350° F. The contaminant barrier is between the first and second inner choke cover members. The second inner choke cover member abuts the gasket of the first inner choke cover member, the second inner choke cover member is RF transparent, and the second inner choke cover member withstands temperatures in excess of 500° F.

According to yet another aspect of the present invention, an oven door comprises an RF choke, an outer choke cover, a first inner choke cover member, a contaminant barrier, and a second inner choke cover member. The RF choke has a first side which is oriented away from a processing an oven, the RF choke has a second side which may be oriented toward a processing chamber of an oven, and the RF choke has a screen between the first and second sides. The outer choke cover is substantially commensurate with the RF choke, the outer choke cover abuts the first side of the RF choke, and the outer choke cover has a panel aligned with the screen of the RF choke. The first inner choke cover member has a gasket, the first inner choke cover member has an opening aligned with the screen of the RF choke, and the first inner choke cover member is microwave safe. The contaminant barrier abuts the first inner choke cover member. The second inner choke cover member abuts the gasket of the first inner choke cover member, the second inner choke cover member abuts the contaminant barrier so that the contaminant barrier is sandwiched between the first and second inner choke cover members, the second inner choke cover member has an opening aligned with the screen of the RF choke and the opening of the first inner choke cover member, and the second inner choke cover member is microwave safe.

According to a further aspect of the present invention, an oven comprises an oven body and an oven door. The oven body has a cooking chamber therein. The oven door is mounted to the oven body and includes an RF choke, an outer choke cover for the RF choke, and an inner choke cover for the RF choke. The RF choke is retained between the outer and inner door covers. The inner choke cover includes first and second microwave safe members and a contaminant barrier. The first microwave safe member is between the RF choke and the contaminant barrier, and the second microwave safe member is between the contaminant barrier and the cooking chamber of the oven body.

BRIEF DESCRIPTION OF THE DRAWINGS

These and other features and advantages of the present invention will become more apparent from a detailed consideration of the invention when taken in conjunction with the drawings in which.

DETAILED DESCRIPTION

Figure 1:
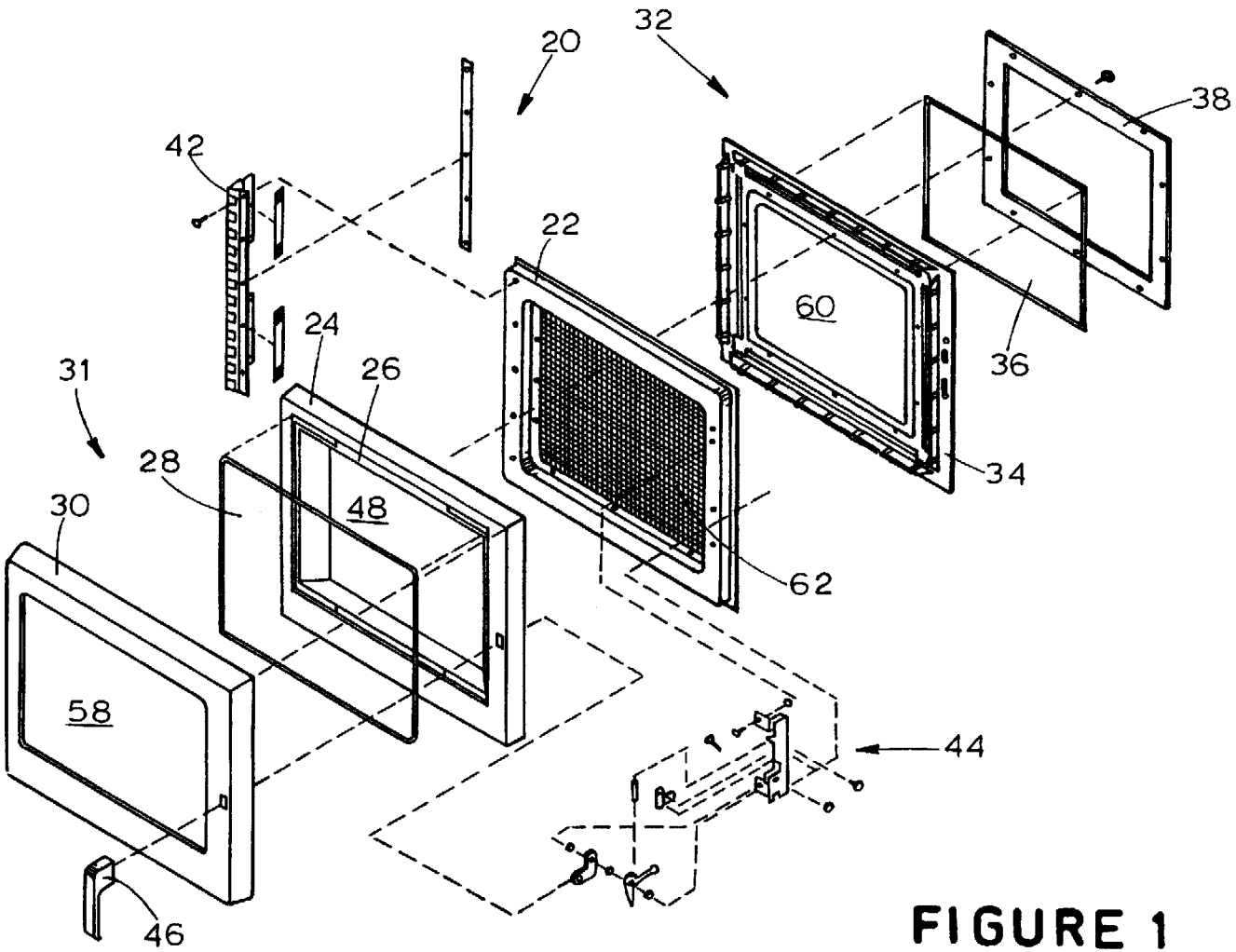
FIG. 1 is an assembly view of an oven door according to the present invention.
Figure 2:
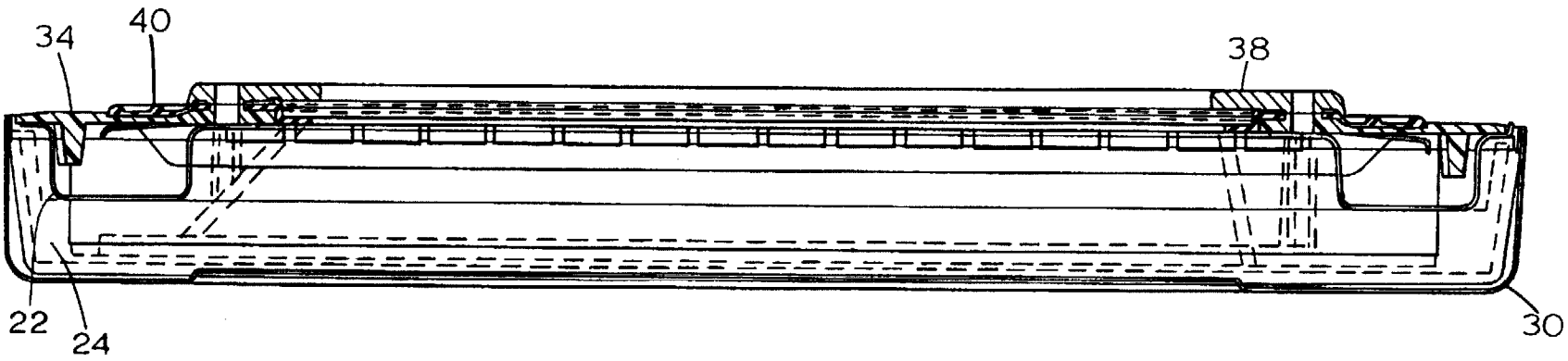
FIG. 2 is a cross sectional view of the oven door shown in FIG. 1.

As shown in FIGS. 1 and 2, an oven door assembly 20 includes a choke 22 which is of conventional design and which typically includes choke fingers (not shown) that are arranged to prevent leakage of RF energy from a cooking chamber of an oven to the oven's exterior. A lens retainer 24 includes a plurality of fastener receiving holes (not shown in FIG. 1) for receiving fasteners. These fasteners may be tightened into the fastener receiving holes of the lens retainer 24 in order to hold the parts of the oven door assembly 20 together after assembly. The lens retainer 24 also has a lens receiving flange 26 which supports a lens 28. The lens 28 may be an opaque, transparent, or semi-transparent glass panel. A cover ring 30, which may be stamped stainless steel, is arranged to snap fit onto the lens retainer 24. Accordingly, the cover ring 30 snaps onto the lens retainer 24 and holds the lens 28 against the lens receiving flange 26 of the lens retainer 24. The lens retainer 24, the lens 28, and the cover ring 30 form an outer choke cover 31.

The oven door assembly 20 also includes an inner choke cover 32. The inner choke cover 32 includes a first inner choke cover member 34, a contaminant barrier 36, and a second inner choke cover member 38. The first inner choke cover member 34 of the inner choke cover 32 has a gasket 40 (FIGS. 6–8) which may be molded onto the first inner choke cover member 34. The gasket 40 may be a silicon gasket. The first inner choke cover member 34 includes a plurality of fastener receiving holes which correspond to the fastener receiving holes of the lens retainer 24 and which allow the fasteners that hold the parts of the oven door assembly 20 together to pass therethrough. The gasket 40 of the first inner choke cover member 34 abuts the front side of the second inner choke cover member 38 as illustrated in FIG. 1. The gasket 40 also has a barrier receiving flange (not shown in FIG. 1) therearound for receiving the contaminant barrier 36, which may be in the form of an opaque, transparent, or semi-transparent glass panel.

The second inner choke cover member 38 of the inner choke cover 32, when fastened to the other elements of the oven door assembly 20, retains the contaminant barrier 36 against the barrier receiving flange of the gasket 40 on the first inner choke cover member 34. Accordingly, the second inner choke cover member 38 includes a plurality of fastener receiving holes which correspond to the fastener receiving holes of the lens retainer 24 and the first inner choke cover member 34 and which allow the fasteners that hold the parts of the oven door assembly 20 together to pass therethrough except for the heads of the fasteners. A door hinge 42 may be fastened to the choke 22 in order to provide a hinge between the oven door assembly 20 and an oven body. A latch assembly 44 may be affixed to the choke 22 and is attached to a handle 46 so that the oven door assembly 20 may be opened and closed.

Figure 3:
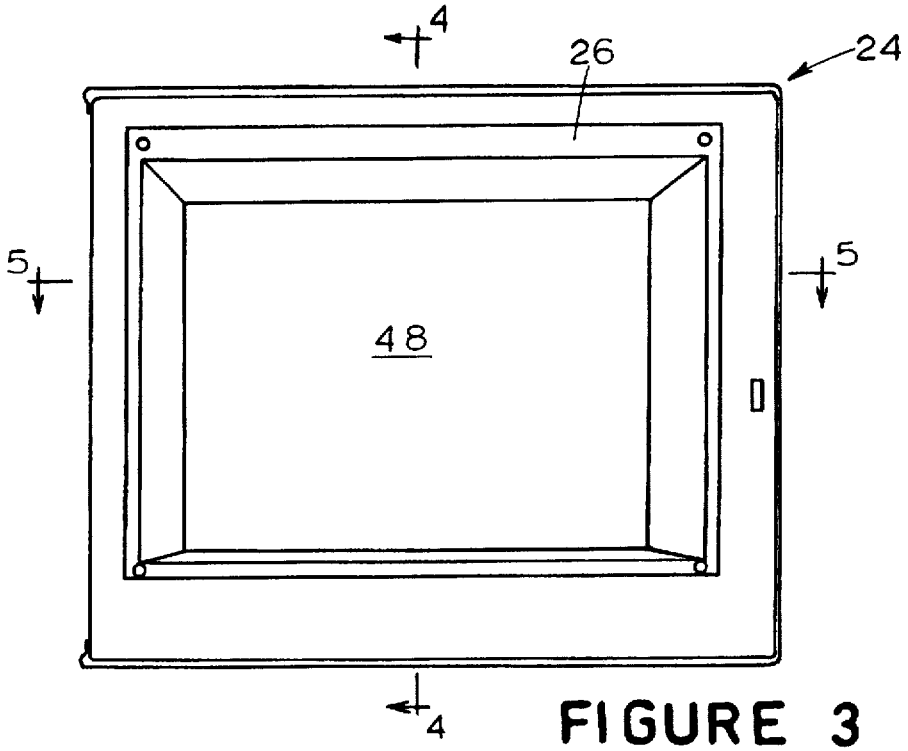
FIG. 3 is a front view of a lens retainer of an outer choke cover of the oven shown in FIG. 1.
Figure 4:
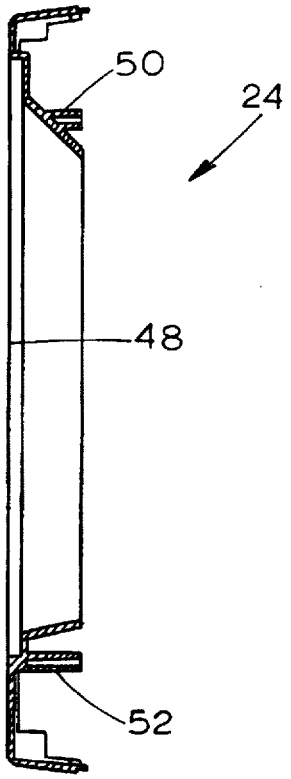
FIG. 4 is a cross sectional view of the lens retainer of the outer choke cover taken along section line 4—4 of FIG. 3.
Figure 5:
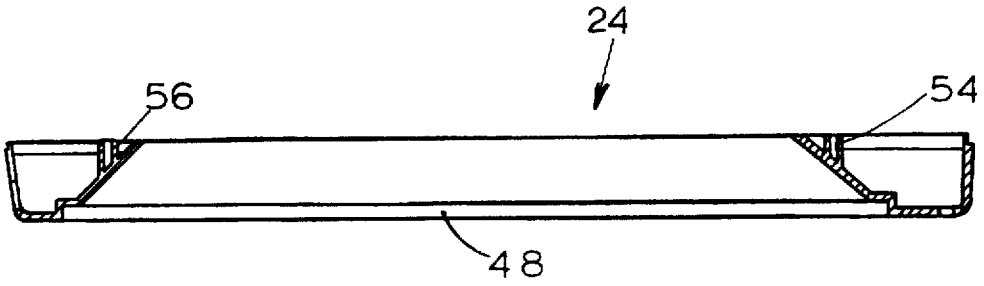
FIG. 5 is a cross sectional view of the lens retainer of the outer choke cover taken along section line 5—5 of FIG. 3.

FIGS. 3–5 illustrate the lens retainer 24 in additional detail. The lens retainer 24 has an opening 48 and a plurality of fastener receiving holes, which include fastener receiving holes 50, 52, 54, and 56. The opening 48 of the lens retainer 24 aligns with the lens 28 and with an opening 58 of the cover ring 30. However, the opening 48 is slightly smaller than the lens 28 so that the lens 28 abuts against the lens receiving flange 26 of the lens retainer 24. The opening 58 is also somewhat smaller than the lens 28. Accordingly, when the cover ring 30 is snapped onto the lens retainer 24, the cover ring 30 exerts a force on the lens 28 to retain the lens 28 against the lens receiving flange 26 of the lens retainer 24. The fastener receiving holes, which include the fastener receiving holes 50, 52, 54, and 56 of the lens retainer 24, receive fasteners which hold the various elements of the oven door assembly 20 together after assembly.

Figure 6:
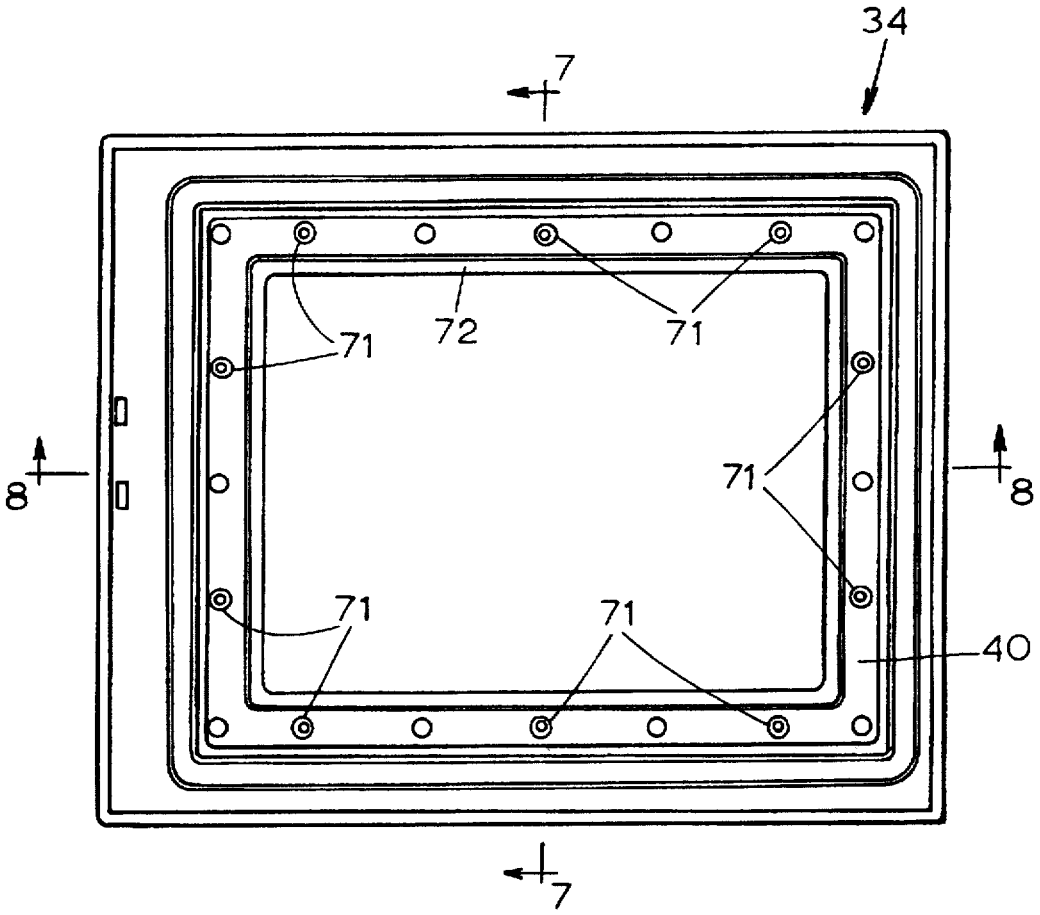
FIG. 6 is a front view of a first inner choke cover member of the oven shown in FIG. 1.
Figure 7:
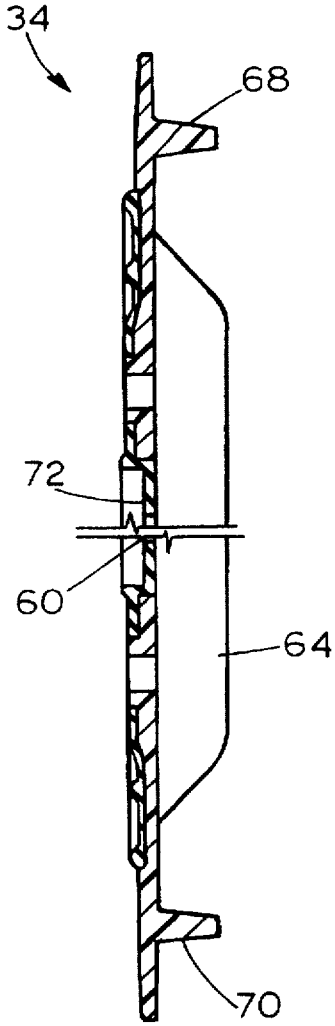
FIG. 7 is a cross sectional view of the first inner choke cover member taken along section line 7—7 of FIG. 6.
Figure 8:
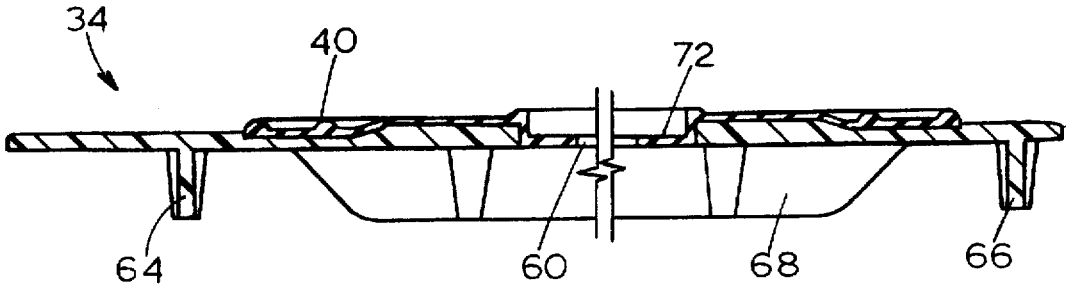
FIG. 8 is a cross sectional view of the first inner choke cover member taken along section line 8—8 of FIG. 6.

The first inner choke cover member 34 of the inner choke cover 32 is shown in more detail in FIGS. 6–8. The first inner choke cover member 34 includes the gasket 40 which may be molded directly thereon. The first inner choke cover member 34 also includes an opening 60 which, as shown in FIG. 1, aligns with a screen 62 of the choke 22, with the opening 48 of the lens retainer 24, with the lens 28, and with the opening 58 of the cover ring 30.

A plurality of ribs 64, 66, 68, and 70 of the first inner choke cover member 34 are received by a recess between the choke fingers and an outer perimeter of the choke 22 (not shown) and may serve to align the first inner choke cover member 34 with the choke 22 during assembly. The first inner choke cover member 34 also has a plurality of fastener receiving holes 71 which align with the fastener receiving holes of the lens retainer 24 in order to receive the fasteners which fasten the oven door assembly 20 together. The gasket 40 includes a barrier receiving flange 72 which supports the contaminant barrier 36. Accordingly, when the outer and inner choke covers 31 and 32 are fastened together, the contaminant barrier 36 is held by the second inner choke cover member 38 against the barrier receiving flange 72 of the gasket 40 on the first inner choke cover member 34.

Figure 9:
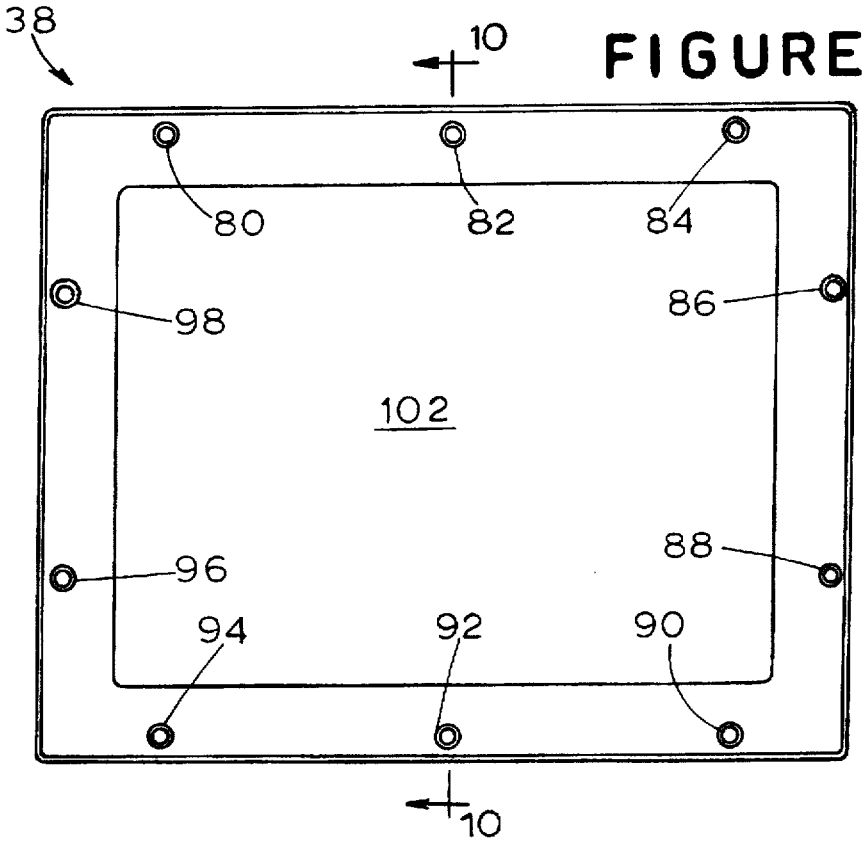
FIG. 9 is a front view of a second inner choke cover member of the oven shown in FIG. 1.
Figure 10:
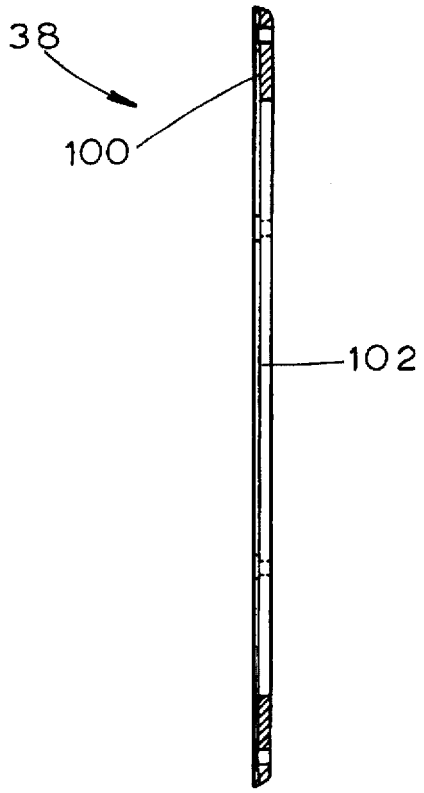
FIG. 10 is a cross sectional view of the second inner choke cover member taken along section line 10—10 of FIG. 9; and, FIG. 11 is an isometric view of a microwave oven having an oven door according to the present invention.

The second inner choke cover member 38 of the inner choke cover 32 is shown in more detail in FIGS. 9 and 10. The second inner choke cover member 38 includes a plurality of fastener receiving holes 80–98 at least some of which receive the fasteners that fasten the parts of the oven door assembly 20 together. The second inner choke cover member 38 also includes a flange 100 which receives the contaminant barrier 36. The second inner choke cover member 38 has an opening 102 which aligns with the openings 48, 58, and 60, with the screen 62, with the lens 28, and with the contaminant barrier 36.

When the oven door assembly 20 as shown in FIG. 1 is assembled, fasteners (shown by dashed lines in FIG. 1) are inserted through one or more of the fastener receiving holes 80–98 of the second inner choke cover member 38, through corresponding fastener receiving holes 71 of the first inner choke cover member 34, and into the corresponding fastener receiving holes 50–56 of the lens retainer 24. These fasteners may be screws which, when tightened, thread into the lens retainer 24. As the fasteners are tightened, (i) the flange 100 of the second inner choke cover member 38 exerts a force on the contaminant barrier 36 to hold the contaminant barrier 36 against the barrier receiving flange 72 of the gasket 40 on the first inner choke cover member 34, and (ii) the first inner choke cover member 34 exerts a force on the choke 22 so as to wedge the choke 22 against the lens retainer 24. The lens 28 is placed against the lens receiving flange 26 of the lens retainer 24, and the cover ring 30 is snapped onto the lens retainer 24 in order to hold the lens 28 to the lens retainer 24. Also, the latch assembly 44 is secured to the choke 22, and the handle 46 is secured to a part of the latch assembly 44 which extends through the lens retainer 24 and the cover ring 30 as illustrated in FIG. 1. The oven door assembly 20, at this stage, is now ready for fastening to an microwave oven body.

Figure 11:
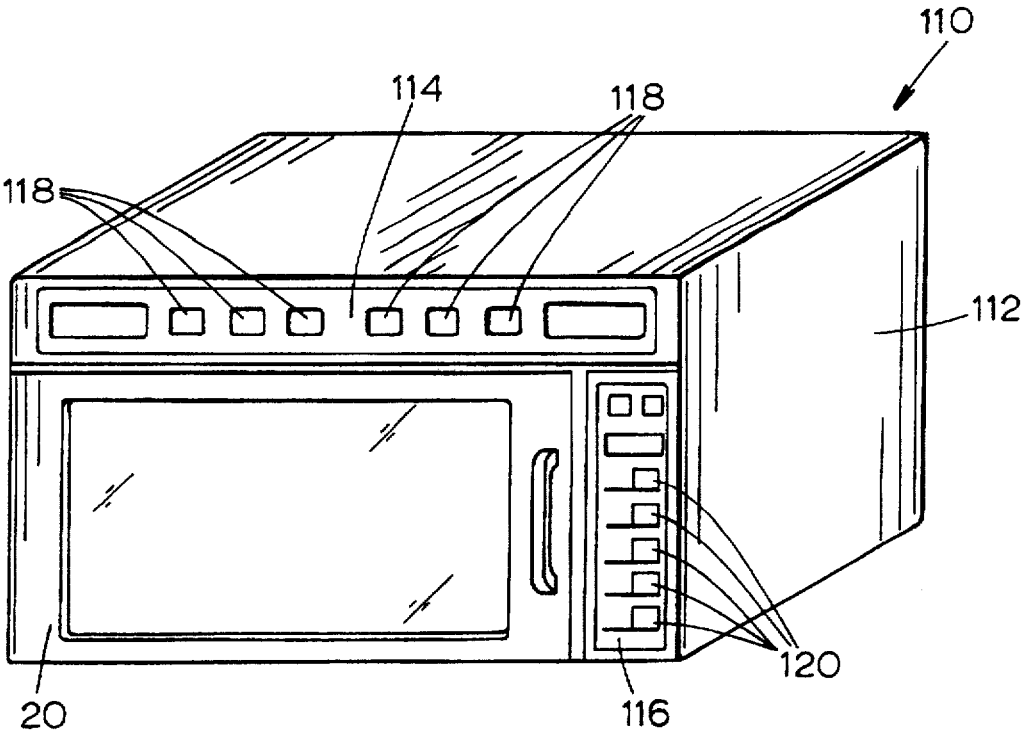

FIG. 11 illustrates an oven 110 having an oven body 112 and the oven door assembly 20 attached thereto. When the oven door assembly 20 is to be attached to the oven body 112, the door hinge 42 is fastened to the oven body 112. Accordingly, the oven door assembly 20 may then be opened in order to permit access to a cooking chamber of the oven body 112.

The oven body 112 has two control areas 114 and 116. The control area 114 may include a plurality of switches 118 for controlling the oven 110 according to a desired microwave and/or convection cooking procedure (time and temperature) which is not preprogrammed into the oven 110. The control area 116 may have switches 120 for initiating preprogrammed cooking procedures of the oven 110. The control areas 114 and 116 may also include various indicating windows.

RF energy is produced during the cooking operation of the oven 110. The choke 22 prevents leakage of this RF energy around the oven door assembly 20 to the exterior of the oven 110. The inner door cover 32, which includes the first inner choke cover member 34, the gasket 40 on the first inner choke cover member 34, the contaminant barrier 36, and the second inner choke cover member 38, prevents contaminants within the cooking chamber of the oven body 112 from soiling the choke 22. Accordingly, cleaning of the oven 112 is enhanced.

The second inner choke cover member 38 of the inner choke cover 32 is preferably made of a microwave safe material. Such a material is transparent to RF energy and is capable of withstanding temperatures in excess of 500° F. without warpage or other structural impairment. Such a material is also temperature resistant, non-hygroscopic (does not absorb moisture), flame resistant, non-toxic (meets National Sanitation Foundation standards), non-brittle, cleaner resistant, and animal fats and food byproducts resistant. Accordingly, the material used for the second inner choke cover member 38, for example, may be a thermoplastic polyimide having a 40% mineral fill. The fill may be glass or any other suitable mineral. The thermoplastic polyimide may be supplied by RTP Company under catalog number 4299X-65690BLK.

The first inner choke cover member 34 of the inner choke cover 32 is also preferably made of a microwave safe material and has the other characteristics of the second inner choke cover member 38. However, because the first inner choke cover member 34 is more removed from the cooking chamber of the oven 110 than the second inner choke cover member 38, the material of the first inner choke cover member 34 need not withstand as high a temperature as the second inner choke cover member 38. The material for the first inner choke cover member 34, for example, is sufficient if it withstands temperatures of around 350° F. The material which may be used for the first inner choke cover member 34 may be a thermal set vinyl ester having approximately 15% glass, 2% titanium oxide, and 60% calcium carbonate which can be ordered under catalog number 840-6506 from BMC (Bulk Molding Compounds, Inc.).

The gasket 40 of the first inner choke cover member 34 may be silicon which is supplied by Rubber Industries (under catalog number RII0408). The lens retainer 24 may be material which can withstand temperatures of around 350° F. For example, the lens retainer 24 may be a polyphenylsulfone having 5% glass and supplied under catalog number 1699X67814A by RTP Company.

Certain modifications of the present invention have been discussed above. Other modifications will occur to those practicing in the art of the present invention. For example, as described above, the oven door assembly 20 comprises a plurality of parts. However, the oven door assembly 20 may comprise fewer or more parts than shown in drawings hereof. Also, preferred materials for the parts described above have been disclosed herein. However, other suitable materials may be used.

Accordingly, the description of the present invention is to be construed as illustrative only and is for the purpose of teaching those skilled in the art the best mode of carrying out the invention. The details may be varied substantially without departing from the spirit of the invention, and the exclusive use of all modifications which are within the scope of the appended claims is reserved.

What is claimed is:

1. An oven door comprising:

an RF choke, wherein the RF choke has an oven facing side and a non-oven facing side;

an outer choke cover for the RF choke;

an inner choke cover for the RF choke, wherein the RF choke is retained between the outer and inner choke covers, wherein the inner choke cover includes first and second members and a contaminant barrier, wherein the first member is between the oven facing side of the RF choke and the contaminant barrier, wherein the contaminant barrier is between the first member and the second member, wherein the first member is RF transparent and withstands temperatures in excess of about 350° F., and wherein the second member is RF transparent and withstands temperatures in excess of about 500° F.

2. The oven door of claim 1 wherein the first member comprises a first plastic material which is RF transparent and which withstands temperatures in excess of 350° F., and wherein the second member comprises a second plastic material which is RF transparent and which withstands temperatures in excess of 500° F.

3. The oven door of claim 1 wherein the first plastic material comprises a thermal set vinyl ester.

4. The oven door of claim 1 wherein the second plastic material comprises a thermoplastic polyimide.

5. The oven door of claim 4 wherein the first plastic material comprises a thermal set vinyl ester.

6. The oven door of claim 1 wherein the second plastic material comprises about 60% thermoplastic polyimide and about 40% mineral fill.

7. The oven door of claim 1 wherein the first member is substantially commensurate with the RF choke and has an opening substantially commensurate with the contaminant barrier, and wherein the second member is substantially commensurate with the RF choke and has an opening substantially commensurate with the contaminant barrier and with the opening of the first member.

8. The oven door of claim 1 wherein the outer choke cover includes first and second members and a panel, wherein the first member of the outer choke cover is between the non-oven facing side of the RF choke and the panel, and wherein the panel is between the first member of the outer choke cover and the second member of the outer choke cover.

9. The oven door of claim 1 wherein the contaminant barrier has an outer periphery, wherein the first and second members have corresponding flanges substantially commensurate with the periphery of the contaminant barrier, and wherein the flanges of the first and second members support the contaminant barrier to the RF choke.

10. An oven door comprising:

an RF choke, wherein the RF choke has a first side which may be oriented away from a processing chamber of an oven, and wherein the RF choke has a second side which may be oriented toward a processing compartment of an oven;

an outer choke cover, wherein the outer choke cover abuts the first side of the RF choke;

a first inner choke cover member, wherein the first inner choke cover member has first and second sides, wherein the first side of the first inner choke cover member abuts the second side of the RF choke, wherein the first inner choke cover member has a gasket on its second side, and wherein the first inner choke cover member is RF transparent and withstands temperatures in excess of about 350° F.;

a second inner choke cover member, wherein the second inner choke cover member abuts the gasket of the first inner choke cover member, wherein the second inner choke cover member is RF transparent, and wherein the second inner choke cover member withstands temperatures in excess of about 500° F.; and, a contaminant barrier, wherein the contaminant barrier is between the first and second inner choke cover members.

11. The oven door of claim 10 wherein the first inner choke cover member comprises a first plastic which is RF transparent and which withstands temperatures in excess of 350° F., and wherein the second inner choke cover member comprises a second plastic which is RF transparent and which withstands temperatures in excess of 500° F.

12. The oven door of claim 11 wherein the gasket is molded onto the first inner choke cover member.

13. The oven door of claim 10 wherein the first plastic comprises a thermal set vinyl ester.

14. The oven door of claim 10 wherein the second plastic comprises a thermoplastic polyimide.

15. The oven door of claim 14 wherein the first plastic comprises a thermal set vinyl ester.

16. The oven door of claim 10 wherein the second plastic comprises about 60% thermoplastic polyimide and about 40% mineral fill.

17. The oven door of claim 10 wherein the outer choke cover includes first and second members and a panel, wherein the first member of the outer choke cover has first and second sides, wherein the panel has first and second sides, wherein the first side of the first member of the outer choke cover abuts the first side of the RF choke, wherein the first side of the panel abuts the second side of the first member of the outer choke cover, and wherein the second member of the outer choke cover abuts the second side of the panel.

18. The oven door of claim 10 wherein the contaminant barrier has an outer periphery, wherein the first and second inner choke cover members have corresponding flanges substantially commensurate with the periphery of the contaminant barrier, and wherein the flanges of the first and second inner choke cover members support the contaminant barrier to the RF choke.

19. An oven door comprising:

an RF choke, wherein the RF choke has a first side which may be oriented away from a processing chamber of an oven, wherein the RF choke has a second side which may be oriented toward a processing chamber of an oven, and wherein the RF choke has a screen between the first and second sides;

an outer choke cover, wherein the outer choke cover is substantially commensurate with the RF choke, wherein the outer choke cover abuts the first side of the RF choke, and wherein the outer choke cover has a panel aligned with the screen of the RF choke;

a first inner choke cover member, wherein the first inner choke cover member has first and second sides, wherein the first side of the first inner choke cover member abuts the second side of the RF choke, wherein the first inner choke cover member has a gasket on its second side, wherein the first inner choke cover member is substantially commensurate with the RF choke, wherein the first inner choke cover member has an opening aligned with the screen of the RF choke, and wherein the first inner choke cover member is microwave safe;

a contaminant barrier, wherein the contaminant barrier abuts the second side of the first inner choke cover member; and, a second inner choke cover member, wherein the second inner choke cover member abuts the gasket of the first inner choke cover member, wherein the second inner choke cover member abuts the contaminant barrier so that the contaminant barrier is sandwiched between the first and second inner choke cover members, wherein the second inner choke cover member is substantially commensurate with the RF choke, wherein the second inner choke cover member has an opening aligned with the screen of the RF choke and the opening of the first inner choke cover member, and wherein the second inner choke cover member is microwave safe.

20. The oven door of claim 19 wherein the first inner choke cover member comprises a first plastic which is RF transparent and which withstands temperatures in excess of 350° F., and wherein the second inner choke cover member comprises a second plastic which is RF transparent and which withstands temperatures in excess of 500° F.

21. The oven door of claim 19 wherein the first plastic comprises a thermal set vinyl ester.

22. The oven door of claim 19 wherein the second plastic comprises a thermoplastic polyimide.

23. The oven door of claim 22 wherein the first plastic comprises a thermal set vinyl ester.

24. The oven door of claim 19 wherein the second plastic comprises about 60% thermoplastic polyimide and about 40% mineral fill.

25. The oven door of claim 19 wherein the gasket is molded onto the first inner choke cover member.

26. The oven door of claim 19 wherein the outer choke cover has first and second outer choke members, wherein the first outer choke member has first and second sides, wherein the panel has first and second sides, wherein the first side of the first outer choke cover member abuts the first side of the RF choke, wherein the first outer choke cover member is substantially commensurate with the RF choke, wherein the first outer choke cover member has an opening aligned with the screen of the RF choke, wherein first side of the panel abuts the second side of the first outer choke cover member, wherein the second outer choke cover member abuts the second side of the panel so that the panel is sandwiched between the first and second outer choke cover members, wherein the second outer choke cover member is substantially commensurate with the RF choke, wherein the second outer choke cover member has an opening aligned with the screen of the RF choke and the opening of the first outer choke cover member.

27. The oven door of claim 19 wherein the contaminant barrier has an outer periphery, wherein the first and second inner choke cover members have corresponding flanges substantially commensurate with the periphery of the contaminant barrier, and wherein the flanges of the first and second inner choke cover members support the contaminant barrier to the RF choke.

28. An oven comprising:

an oven body having a cooking chamber therein; and, an oven door mounted to the oven body, the oven door including an RF choke, an outer choke cover for the RF choke, and, an inner choke cover for the RF choke, wherein the RF choke is retained between the outer and inner choke covers, wherein the inner choke cover includes first and second microwave safe members and a contaminant barrier, wherein the first microwave safe member is between the RF choke and the contaminant barrier, and wherein the second microwave safe member is between the contaminant barrier and the cooking chamber of the oven body.

29. The oven door of claim 28 wherein the outer choke cover includes first and second outer choke cover members and a panel, wherein the first outer choke cover member is between the RF choke and the panel, and wherein the panel is between the first and second outer choke cover members.

30. The oven door of claim 28 wherein the first microwave safe member is substantially commensurate with the RF choke and has an opening substantially commensurate with the contaminant barrier, and wherein the second microwave safe member is substantially commensurate with the RF choke and has an opening substantially commensurate with the contaminant barrier and with the opening of the first microwave safe member.

31. The oven door of claim 28 wherein the contaminant barrier has an outer periphery, wherein the first and second microwave safe members have corresponding flanges substantially commensurate with the periphery of the contaminant barrier, and wherein the flanges of the first and second microwave safe members support the contaminant barrier to the RF choke.

* * * * *